US007090765B2

(12) United States Patent
Spicer et al.

(10) Patent No.: US 7,090,765 B2
(45) Date of Patent: Aug. 15, 2006

(54) PROCESS FOR CRACKING HYDROCARBON FEED WITH WATER SUBSTITUTION

(75) Inventors: David B. Spicer, Houston, TX (US); Arthur R. Dinicolantonio, Seabrook, TX (US); James Mitchell Frye, Pebble Bay (SG); Richard C. Stell, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 440 days.

(21) Appl. No.: 10/188,901

(22) Filed: Jul. 3, 2002

(65) Prior Publication Data

US 2004/0004027 A1 Jan. 8, 2004

(51) Int. Cl.
*C10G 9/00* (2006.01)
*C10G 15/00* (2006.01)

(52) U.S. Cl. ..... 208/130; 208/106; 208/125; 208/128; 585/648; 585/649; 585/650; 585/652

(58) Field of Classification Search ..... 208/128, 208/130, 106, 125; 585/648, 649, 650, 652
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | |
| 3,341,429 | A | 9/1967 | Fondrk | |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | |
| 3,505,210 | A | 4/1970 | Wallace et al. | |
| 3,617,493 | A | 11/1971 | Wirth et al. | 208/80 |
| 3,677,234 | A | 7/1972 | Dutkiewicz | |
| 3,718,709 | A | 2/1973 | Simonetta | 260/683 R |
| 3,900,300 | A | 8/1975 | Lehman | |
| 4,199,409 | A | 4/1980 | Skraba | |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | |

(Continued)

FOREIGN PATENT DOCUMENTS

DE 10 93 351 11/1960

(Continued)

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

(Continued)

*Primary Examiner*—Glenn Caldarola
*Assistant Examiner*—Prem C. Singh
(74) *Attorney, Agent, or Firm*—James A. Zboray

(57) ABSTRACT

A process for treating hydrocarbon feed in a furnace, the process comprising: (a) heating hydrocarbon feed, (b) adding water to the heated feed, (c) adding dilution steam to the heated feed to form a mixture, (d) heating the resulting mixture and feeding the resulting heated mixture to the furnace, wherein the water in (b) is added in an amount of from at least about 1% to 100% based on water and dilution steam by weight.

33 Claims, 3 Drawing Sheets

U.S. PATENT DOCUMENTS

| | | | | |
|---|---|---|---|---|
| 4,400,182 | A | 8/1983 | Davies et al. | |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian et al. | |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A * | 7/2000 | Swan | 208/113 |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B1 | 6/2004 | Powers | |
| 2001/0016673 | A1 | 8/2001 | Bridges et al. | |
| 2003/0070963 | A1 | 4/2003 | Zimmermann et al. | |
| 2004/0004022 | A1 | 1/2004 | Stell et al. | |
| 2004/0004028 | A1 | 1/2004 | Stell et al. | |
| 2004/0039240 | A1 | 2/2004 | Powers | |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0 063 448 | 10/1982 |
| EP | 0 423 960 | 9/1990 |
| EP | 0 434 049 | 12/1990 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 10/1977 |
| GB | 2 012 176 | 11/1977 |
| JP | 3111491 | 5/1991 |
| NL | 7410163 | 4/1975 |
| SU | 1491552 | 7/1989 |
| WO | WO 01/55280 | 8/2001 |
| WO | WO 2004/005433 | 1/2004 |
| ZA | 907394 | 9/1990 |

OTHER PUBLICATIONS

ABB Lummus Crest Inc., (presentation) HOPS, "Heavy Oil Processing System", Jun. 15, 1992 TCC PEW Meeting, pp. 1-18.

Lummus Crest Inc., JP03111491 (Abstract), May 13, 1991.

Mitsui Sekka Engineering Co., Ltd./Mitsui Engineering & Shipbuilding Co., Ltd., "Mitsui Advanced Cracker & Mitsui Innovative Quencher", pp. 1-16.

"Specialty Furnace Design: Steam Reformers and Steam Crackers", presented by T.A. Wells of the M.W. Kellogg Company, 1988 AlChE Spring National Meeting.

* cited by examiner

PROCESS FOR CRACKING HYDROCARBON FEED WITH WATER SUBSTITUTION

BACKGROUND OF THE INVENTION

1. Field of the Invention

The present invention relates to the cracking of hydrocarbon feed using water as a supplement to or substitute for dilution steam.

2. Description of Background

Steam cracking has long been used to crack various hydrocarbon feeds into olefins. Conventional steam cracking utilizes a pyrolysis furnace, which has two main sections: a convection section and a radiant section reaction zone. The hydrocarbon feed typically enters the convection section of the furnace as a liquid (except for light feeds which enter as a vapor) wherein it is typically heated and vaporized by indirect contact with hot flue gas from the radiant section and by mixing with steam. The vaporized feed and steam mixture is then introduced into the radiant section where the cracking takes place. The resulting products including olefins leave the pyrolysis furnace for further downstream processing, such as quenching.

By way of non-limiting illustration, in a typical pyrolysis reactor furnace for the production of ethylene from naphtha feed, the hydrocarbon feed enters the convection section of the furnace where it is preheated in first heat exchange tubes by indirect contact with furnace flue gas from the radiant section. A dilution steam stream can enter the convection section wherein it is superheated, also in heat exchange tubes by indirect contact with furnace flue gas from the radiant section. The superheated dilution steam is then mixed with the hydrocarbon feed to reduce the hydrocarbon partial pressure in the radiant section reaction zone of the furnace. It is well known in the art that reducing the hydrocarbon partial pressure in the reaction zone (1) increases the selectivity of the reactor to desired olefinic products such as ethylene, and (2) reduces the rate at which undesirable coke is formed and deposited on the interior surfaces of radiant section tubes. The superheated steam is mixed with the preheated hydrocarbon feed producing a vapor hydrocarbon/steam mixture which is further preheated to a temperature suitable for conveying the mixture to the radiant section of the furnace. The cracking reactions which produce the desired ethylene product and other byproducts take place predominantly in the radiant section of the furnace. After leaving the radiant section, the reactor effluent is rapidly quenched in a quench system to stop the cracking reactions.

For well-known energy efficiency purposes, it is desirable to recover as much heat as possible from the flue gas leaving the radiant section and flowing through the convection section of the furnace to the furnace flue gas exhaust. Thus, hydrocarbon feed and dilution steam are heated in the convection section, typically by indirect contact with flue gas from the radiant section. Other recovery services may also be included in the convection section such as a boiler feed water preheater and/or a steam superheater used to superheat high pressure steam which may be generated in the quench system of the furnace.

In some furnace designs, boiler feed water preheat and/or high pressure steam superheat services may not be available to absorb heat from the flue-gas stream flowing through the convection section. In such cases, the flue gas may exit the furnace at unacceptably high temperatures, for example, as high as 600–700° F. This represents a substantial energy inefficiency, as some designs provide for flue-gas discharge temperatures as low as, for example, 250–300° F.

In other instances, it may be desirable to provide additional dilution steam to further decrease the hydrocarbon feed partial pressure. But such steam may not be available at reasonable cost.

The present invention provides an advantage of providing for additional dilution steam when it is otherwise unavailable at a reasonable cost.

The present invention also provides another advantage of improving furnace energy efficiency. These and other features and advantages of the present invention will become apparent from the following description and claims.

Separate applications, one entitled "CONVERTING MIST FLOW TO ANNULAR FLOW IN THERMAL CRACKING APPLICATION," U.S. application Ser. No. 10/189,168, Family Number 2002B064, filed Jul. 3, 2002, and one entitled "PROCESS FOR STEAM CRACKING HEAVY HYDROCARBON FEEDSTOCKS", U.S. application Ser. No. 10/188,461, Family Number 2002B063, filed Jul. 3, 2002, are being concurrently filed herewith and are incorporated herein by reference.

SUMMARY OF THE INVENTION

The present invention provides a process for treating hydrocarbon feed in a furnace, the process comprising: (a) heating hydrocarbon feed, (b) adding water and dilution steam to the heated feed to form a mixture, (c) heating the mixture and (d) feeding the heated mixture from (c) to the furnace, wherein the water in (b) is added in an amount of from at least about 1% to 100% based on water and dilution steam by weight. In one embodiment, the water is added in an amount of at least about 3% based on water and dilution steam by weight (i.e., from at least about 3% to 100% water). In another embodiment, the water is added in an amount of at least about 10% based on water and dilution steam by weight. In a further embodiment, the water is added in an amount of at least about 30% based on water and dilution steam by weight. In accordance with the present invention, water can be a total substitute for dilution steam (i.e., no addition of steam). It is preferred, however, that both dilution steam and water are added to the hydrocarbon feed.

According to a preferred embodiment, the water is added prior to the addition of dilution steam, if any.

According to another embodiment, the ratio of water to steam added to the heated feed is varied according to fluctuations in at least one process variable. In a preferred embodiment, the process variable is process temperature. In this regard, the process temperature can be the temperature of the flue gas exiting the furnace, the temperature of process in the convection section of the furnace and/or the temperature of process to the radiant section (reaction zone) of the furnace.

According to a further embodiment, the water is added to the hydrocarbon feed in a sparger and dilution steam, if any, is added to the feed in another sparger. In a preferred embodiment, a first and a second sparger are part of a sparger assembly in which the first and second spargers are connected in fluid flow communication in series.

The present invention also provides a process for cracking hydrocarbon feed in a furnace, the furnace comprising a radiant section comprising burners that generate radiant heat and hot flue gas, and a convection section comprising heat exchange tubes, the process comprising:

(a) preheating the hydrocarbon feed in heat exchange tubes in the convection section by indirect heat exchange with the hot flue gas from the radiant section to provide preheated feed;

(b) adding water to the preheated feed in a first sparger and adding dilution steam to the preheated feed in a second sparger to form a feed mixture;

(c) heating the feed mixture in heat exchange tubes in the convection section by indirect heat transfer with hot flue gas from the radiant section to form a heated feed mixture; and (d) feeding the heated feed mixture to the radiant section wherein the hydrocarbon in the heated feed mixture is thermally cracked to form products;

wherein the water in (b) is added in an amount of from at least about 1% to 100% based on water and dilution steam by weight.

In a preferred embodiment, the first sparger comprises an inner perforated conduit surrounded by an outer conduit so as to form an annular flow space between the inner and outer conduits. Preferably, the preheated hydrocarbon flows through the annular flow space and the water flows through the inner conduit and is injected into the preheated hydrocarbon feed through the openings (perforations) in the inner conduit.

In yet another preferred embodiment, the second sparger comprises an inner perforated conduit surrounded by an outer conduit so as to form an annular flow space between the inner and outer conduits. Preferably, the feed from the first sparger flows through the annular flow space and the dilution steam flows through the inner conduit and is injected into the first feed mixture through the openings (perforations) in the inner conduit.

In a further preferred embodiment, the first and second spargers are part of a sparger assembly in which the first and second spargers are connected in fluid flow communication in series.

DETAILED DESCRIPTION OF THE INVENTION

Unless otherwise stated, all percentages, parts, ratios, etc., are by weight. Unless otherwise stated, a reference to a compound or component includes the compound or component by itself, as well as in combination with other compounds or components, such as mixtures of compounds.

Further, when an amount, concentration, or other value or parameters is given as a list of upper preferable values and lower preferable values, this is to be understood as specifically disclosing all ranges formed from any pair of an upper preferred value and a lower preferred value, regardless whether ranges are separately disclosed.

The present invention relates to a process for treating hydrocarbon feed in a furnace. According to one embodiment, the process comprises (a) heating hydrocarbon feed, (b) adding water and dilution steam to the heated feed to form a mixture, (c) heating the mixture and (d) feeding the heated mixture from (d) to the furnace, wherein the water in (b) is added in an amount of from at least about 1% to 100% based on water and dilution steam by weight.

Figure 1:
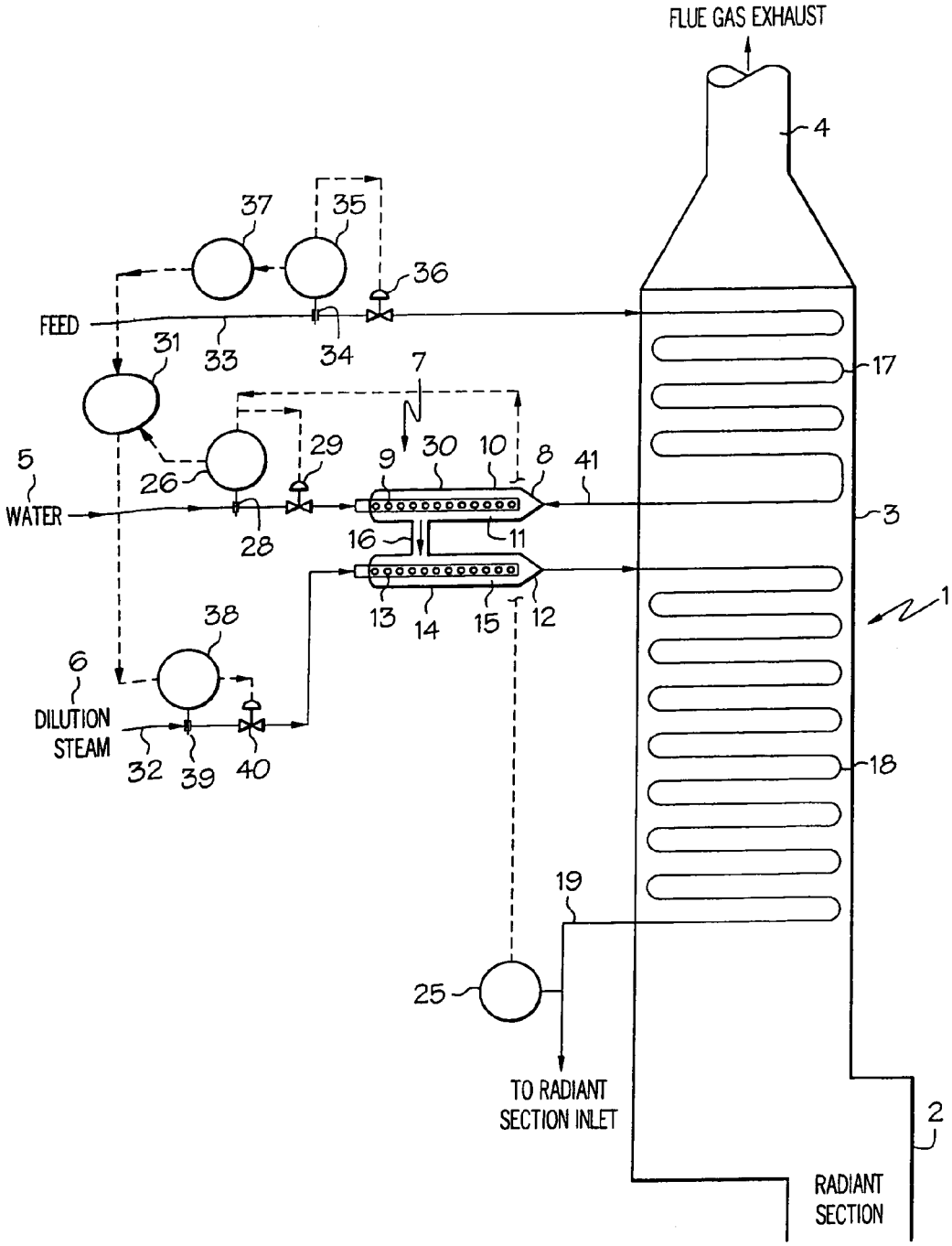
FIG. 1 illustrates a schematic flow diagram of a process in accordance with the present invention employed with a pyrolysis furnace, with particular emphasis on the convection section of the furnace. This figure also shows a control schematic for varying the ratio of water to dilution steam according to a process variable, namely, the temperature of process gas to the radiant section of the furnace.

With particular reference to FIG. 1, 1 generally refers to a pyrolysis furnace comprised of a lower radiant section 2, an intermediate convection section 3 and an upper flue gas exhaust section 4. In the radiant section, radiant burners provide radiant heat to hydrocarbon feed to produce the desired products by thermal cracking of the feed. The burners generate hot gas that flows upwardly through convection section 3 and then out of the furnace through flue gas exhaust section 4. As shown in FIG. 1, hydrocarbon feed 33 enters an upper portion of the convection section 3 where it is preheated. The preheating of the hydrocarbon feed can take any form known by those of ordinary skill in the art. However, it is preferred that the heating comprises indirect contact of the feed in the upper convection section 3 of the furnace 1 with hot flue gases from the radiant section of the furnace. This can be accomplished, by way of non-limiting example, by passing the feed through heat exchange tubes 17 located within the convection section 3 of the furnace 1. The preheated feed has a temperature between 200 to 600° F. (95 to 315° C.). Preferably the temperature of the heated feed is about 300 to 500° F. (150 to 260° C.) and more preferably between 350 to 500° F. (175 to 260° C.).

After the preheated hydrocarbon feed exits the convection section at 41, water 5 and dilution steam 6 are added thereto to form a mixture. Water is added to the preheated feed in an amount of from at least about 1% to 100% based on the total amount of waler and dilution steam added by weight. Preferably, the water is added in an amount of at least about 3% (i.e., about 3% to about 100% water) based on water and dilution steam by weight. More preferably, the water is added in an amount of at least about 10%. most preferably at least about 30%, based on water and dilution steam by weight. It is understood that, in accordance with an embodiment of the invention, 100% water could be added to the hydrocarbon feed such that no dilution steam is added. The sum of the water flow and dilution steam flow provides the total desired reaction zone $H_2O$ required to achieve the desired hydrocarbon partial pressure.

As shown in FIG. 1, water 5 is preferably added to the preheated feed 41 prior to addition of dilution steam. It is believed that this order of addition will reduce undesirable pressure fluctuations in the process stream originating from mixing the hydrocarbon, water and dilution steam. Such fluctuations are commonly referred to as water-hammer or steam-hammer. While the addition of water and dilution steam to the preheated hydrocarbon feed could be accomplished using any known mixing device, it is preferred to use a sparger assembly 7 as illustrated in the drawings. Water is preferably added in a first sparger 8. As shown, first sparger 8 comprises an inner perforated conduit 9 surrounded by an outer conduit 10 so as to form an annular flow space 11 between the inner and outer conduits. Preferably, the preheated hydrocarbon feed 41 flows through the annular flow space 11. Also preferably, water 5 flows through the inner perforated conduit 9 and is injected into the preheated hydrocarbon feed through the openings (perforations) shown in inner conduit 9.

Dilution steam 6 is preferably added to the preheated hydrocarbon feed in a second sparger 12. As shown, second sparger 12 comprises an inner perforated conduit 13 surrounded by an outer conduit 14 so as to form an annular flow space 15 between the inner and outer conduits. Preferably, the preheated hydrocarbon feed 41 to which the water has been added flows through the annular flow space 15. Also preferably, dilution steam flows through the inner perforated conduit 13 and is injected into the preheated hydrocarbon feed through the openings (perforations) shown in inner conduit.

Preferably, the first and second spargers are part of a sparger assembly as shown in which the spargers are connected in fluid flow communication in series. As shown in the drawings, the spargers 8 and 12 are interconnected in fluid flow communication in series by fluid flow interconnector 16.

As further illustrated in the drawings, upon exiting the sparger assembly 7, the mixture (of hydrocarbon feed, water and dilution steam) flows back into furnace 1 wherein the mixture is further heated in a lower portion of convection section 3. The further heating of the hydrocarbon feed can take any form known by those of ordinary skill in the art. However, it is preferred that the heating comprises indirect contact of the feed in the lower convection section 3 of the furnace 1 with hot flue gases from the radiant section of the furnace. This can be accomplished, by way of non-limiting example, by passing the feed through heat exchange tubes 18 located within the convection section 3 of the furnace 1. Following the additional heating of the mixture at 18, the resulting heated mixture exits the convection section at 19 and then flows to the radiant section of the furnace for thermal cracking of the hydrocarbon. The heated feed to the radiant section preferably has a temperature between 800 to 1400° F. (425 to 760° C.). Preferably the temperature of the heated feed is about 1050 to 1350° F. (560 to 730° C.).

FIG. 1 further illustrates using the invention to control the process temperature to the radiant section 2. The process temperature is an input to a controller 26 which controls the flaw rate of water via a flow meter 28 and a control valve 29. The water then enters the sparger assembly 7. When the process temperature is too high, controller 26 increases the flow of water 5.

Controller 26 also sends the flow rate signal to a computer control application schematically shown at 31, which determines the dilution steam flow rate as detailed below. A pre-set flow rate of the hydrocarbon feed 33 is measured by flow meter 34, which is an input to controller 35, which in turn sends a signal to feed control valve 36. Controller 35 also sends the feed rate signal to a computer control application 37, which determines the total $H_2O$ to the radiant section by multiplying the feed rate by a pre-set total $H_2O$ to feed rate ratio. The total $H_2O$ rate signal is the second input to computer application 31. Computer application 31 subtracts the water flow rate from the total $H_2O$ rate; the difference is the set point for the dilution steam controller 38. Flow meter 39 measures the dilution steam rate, which is also an input to the controller 38. When water flow rate increases, as discussed above, the set point inputted to the dilution steam controller 38 decreases. Controller 38 then instructs control valve 40 to reduce the dilution the steam rate 32 to the new set point. When the process temperature 25 is too low the control scheme instructs control valve 29 to reduce water rate and instructs control valve 40 to increase the steam rate while maintaining constant total $H_2O$ rate.

Figure 2:
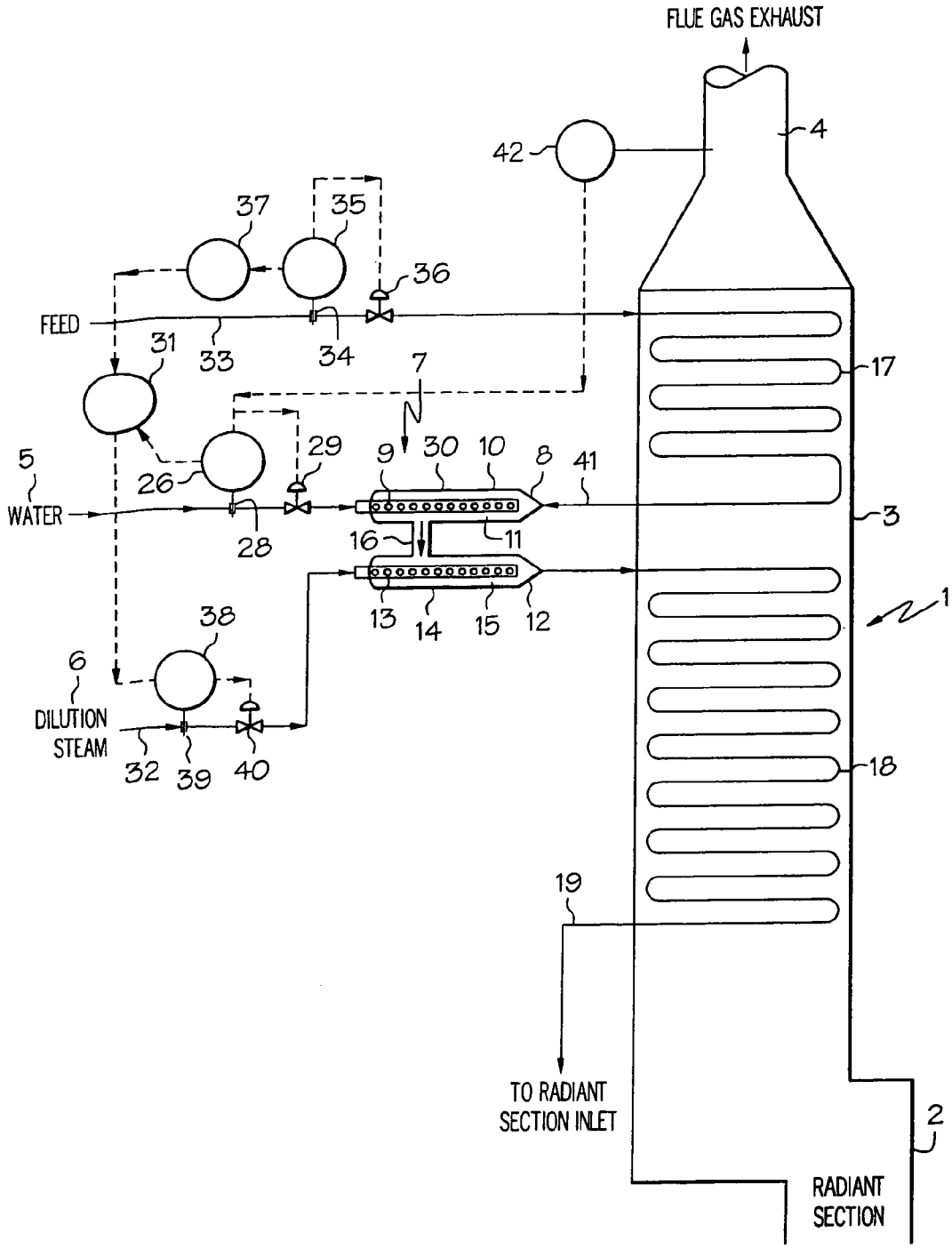
FIG. 2 illustrates a schematic diagram of a control system for use in varying the ratio of water to dilution steam in connection with a process parameter, specifically, the temperature of the flue gas exiting the furnace.
Figure 3:
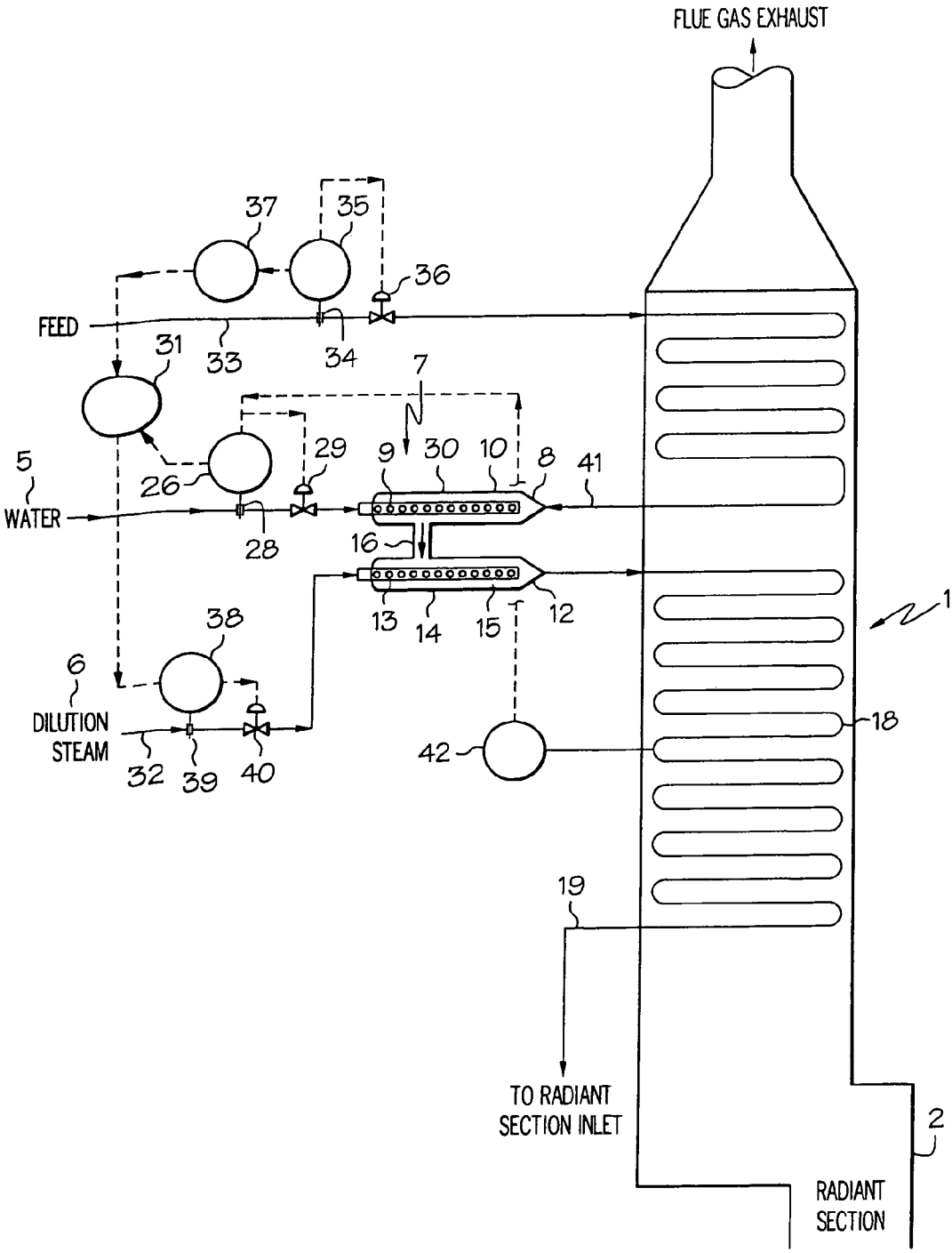
FIG. 3 illustrates a schematic diagram of the same control system, but for varying the ratio of water to dilution steam in connection with the temperature of process gas in the convection section of the furnace.

Alternatively, this control scheme works the same way to control the discharge temperature of the flue gas 42 as illustrated in FIG. 2, and to control the process temperature in the convection section of the furnace, illustrated in FIG. 3. In connection with controlling the temperature of the flue gas discharge, it is preferred that flue gas exits at a temperature of less than about 650° F., preferably less than about 450° F., more preferably less than about 350° F.

Processes in accordance with the present invention make it possible to maintain a desired hydrocarbon partial pressure in the radiant section reaction zone of a furnace, while increasing the convection section heat recovery requirement due to the heat of vaporization of the water stream. Such a system can result in a lower flue-gas discharge temperature and, thus, a more energy efficient furnace.

Similarly, processes in accordance with the present invention enable the desired reaction zone hydrocarbon partial pressure to be maintained in a facility where the available supply of dilution steam is limited and/or is insufficient for the desired furnace operating conditions.

Although the present invention has been described in considerable detail with reference to certain preferred embodiments, other embodiments are possible and will become apparent to one skilled in the art. Therefore, the spirit and scope of the appended claims should not be limited to the descriptions of the preferred embodiments contained herein.

What is claimed is:

1. A process for treating hydrocarbon feed in a furnace having a convection section and a radiant section, the process comprising: (a) heating the hydrocarbon feed, (b) first adding water and then dilution steam to the heated feed to form a mixture, (c) heating the mixture in the convection section of the furnace and (d) feeding the heated mixture from (c) to the radiant section of the furnace, wherein step (b) of first adding water and then adding steam to the heated mixture reduces pressure fluctuations in said mixture, and (d) varying the ratio of water to steam added to the feed according to fluctuations in at least one process variable to maintain at least one of said process variables substantially constant.

2. The process of claim 1, wherein the water is added in an amount of at least about 3% by weight.

3. The process of claim 1, wherein the water is added in an amount of at least about 10% by weight.

4. The process of claim 1, wherein the water is added in an amount of at least about 30% by weight.

5. The process of claim 1, wherein the furnace further comprises a flue gas section, and wherein the at least one process variable is selected from; the temperature of the heated mixture leaving the convection section, the discharge temperature of the flue gas, and the temperature of the flue gas in the convection section.

6. The process of claim 5, wherein the resulting heated mixture is fed to the radiant section of the furnace, and wherein the process variable is the temperature of the resulting heated mixture prior to entering the radiant section of the furnace.

7. The process of claim 5, wherein the discharge temperature of the flue gas in the flue gas section is less than about 650° F.

8. The process of claim 7 wherein the discharge temperature of the flue gas in the flue gas section is less than about 450° F.

9. The process of claim 8, wherein the discharge temperature of the flue gas in the flue gas section is less than about 350° F.

10. The process of claim 1, wherein water is added in a sparger, and wherein the dilution steam, is added to the heated feed in another sparger.

11. The process of claim 2, wherein water is added in a sparger, and wherein the dilution steam, is added to the heated feed in another sparger.

12. The process of claim 3, wherein water is added in a sparger, and wherein the dilution steam, is added to die heated feed in another sparger.

13. The process of claim 10, wherein the first and second spargers are part of a sparger assembly in which the first and second spargers are connected in fluid flow communication in series.

14. The process of claim 1, wherein the furnace is a steam cracking furnace.

15. The process of claim 2, wherein the furnace is a steam cracking furnace.

16. The process of claim 5, wherein the furnace is a steam cracking furnace.

17. The process of claim 10, wherein the furnace is a steam cracking furnace.

18. The process of claim 13, wherein the furnace is a steam cracking furnace.

19. A process for cracking hydrocarbon feed in a furnace, the furnace comprising a radiant section comprising burners that generate radiant beat and hot flue gas, and a convection section comprising heat exchange tubes, the process comprising:

(a) preheating the hydrocarbon feed in heat exchange tubes in the convection section by indirect heat exchange with the hot flue gas from the radiant section to provide preheated feed;

(b) first adding water to the preheated fee in a first sparger and then adding dilution steam to the preheated feed in a second sparger to form a feed mixture;

(c) heating the feed mixture in beat exchange tubes in the convection section by indirect heat transfer with hot flue gas from the radiant section to form a heated feed mixture; and (d) feeding the heated feed mixture to the radiant section wherein the hydrocarbon in the heated feed mixture is thermally cracked to form products;

wherein the water in (b) is added in an amount of from at least about 1% to 100% based on water and dilution steam by weight.

20. The process of claim 19, wherein the first sparger comprises an inner perforated conduit surrounded by an outer conduit so as to form an annular flow space between the inner and outer conduits.

21. The process of claim 20, wherein the preheated feed flows through the annular flow space and wherein the water flows through the inner conduit and is injected into the preheated hydrocarbon feed through the openings in the inner conduit.

22. The process of claim 19, wherein the second sparger comprises an inner perforated conduit surrounded by an outer conduit so as to form an annular flow space between the inner and outer conduits.

23. The process of claim 22, wherein the feed from the first sparger flows through the annular flow space and wherein the dilution steam flows through the inner conduit and is injected into the first feed mixture through the openings in the inner conduit.

24. The process of claim 19, wherein the first and second spargers are part of a sparger assembly in which the first and second spargers are connected in fluid flow communication in series.

25. The process of claim 1 wherein the ratio of water to steam is varied so as to provide hydrocarbon partial pressure in the radiant section to increase the selectivity to olefinic products.

26. The process of claim 19, wherein the water is added in an amount of at least about 3% by weight.

27. The process of claim 19, wherein the water is added in an amount of at least about 10% by weight.

28. The process of claim 19, wherein the water is added in an amount of at least about 30% by weight.

29. The process of claim 1, wherein the at least one process variable is selected from: the temperature of the heated mixture leaving the convection section, the discharge temperature of flue gas, the temperature of the flue gas in the convection section; and the temperature of the resulting heated mixture prior to entering the radiant section of the furnace.

30. The process of claim 29, wherein the discharge temperature of the flue gas is less than about 650° F.

31. The process of claim 29, wherein the discharge temperature of the flue gas is less than about 450° F.

32. The process of claim 29, wherein the discharge temperature of the flue gas is less than about 350° F.

33. The process of claim 4, wherein water is added in a sparger, and wherein the dilution steam is added to the heated feed in another sparger.

* * * * *